US011801541B2

(12) United States Patent
Bucci et al.

(10) Patent No.: US 11,801,541 B2
(45) Date of Patent: Oct. 31, 2023

(54) GUIDE DEVICE FOR GUIDING A DRIVING BAR OF A MANDREL OR FOR GUIDING A MANDREL IN A ROLLING PROCESS OF TUBULAR BODIES

(71) Applicant: DANIELI & C. OFFICINE MECCANICHE S.p.A., Buttrio (IT)

(72) Inventors: Annibale Bucci, Dalmine (IT); Marco Lange', Brusaporto (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 0 days.

(21) Appl. No.: 17/635,181

(22) PCT Filed: Aug. 20, 2020

(86) PCT No.: PCT/IB2020/057824
§ 371 (c)(1),
(2) Date: Feb. 14, 2022

(87) PCT Pub. No.: WO2021/033156
PCT Pub. Date: Feb. 25, 2021

(65) Prior Publication Data

US 2022/0219213 A1 Jul. 14, 2022

(30) Foreign Application Priority Data

Aug. 22, 2019 (IT) ..... 102019000014925

(51) Int. Cl.
*B21B 17/04* (2006.01)
*B21B 25/02* (2006.01)

(52) U.S. Cl.
CPC ..... *B21B 17/04* (2013.01); *B21B 25/02* (2013.01)

(58) Field of Classification Search
CPC ..... B21B 17/02; B21B 17/04; B21B 25/00; B21B 25/02; B23Q 1/76; B23Q 1/766
See application file for complete search history.

(56) References Cited

U.S. PATENT DOCUMENTS 1,950,929 A 3/1934 Olson
2,083,698 A 6/1937 Engelbertz
(Continued)

FOREIGN PATENT DOCUMENTS

CN 101758075 A 6/2010
DE 1082214 B * 5/1960 ..... B21B 25/02
(Continued)

OTHER PUBLICATIONS

EP 2881218 A1, Maringer Jun. 2015.*
(Continued)

*Primary Examiner* — Edward T Tolan
(74) *Attorney, Agent, or Firm* — STETINA BRUNDA GARRED AND BRUCKER

(57) ABSTRACT

The present invention relates to a device for guiding a movable element, in particular a driving bar of a mandrel or a mandrel, in a rolling mill with mandrel. The device according to the invention comprises a support structure for the advancement of the movable element along an advancement direction. The device comprises a first slide and a second slide which are carried by said support structure and are slidable along a transverse direction which is substantially orthogonal to said advancement direction, in which each slide carries two abutment surfaces for guiding the movable element and in which each slide is movable along said transverse direction between at least a first operating position, upon reaching which said abutment surfaces are susceptible to coming into contact with a movable element of a first predefined diameter, and at least a second operating position, upon reaching which said abutment surfaces are
(Continued)

susceptible to coming into contact with a movable element of a second predefined diameter. According to the invention, the device comprises actuating means which move the slides along the transverse direction between the operating positions and lock the slides themselves when one of said operating positions is reached.

14 Claims, 14 Drawing Sheets

(56) References Cited

U.S. PATENT DOCUMENTS

| | | | | |
|---|---|---|---|---|
| 2,263,744 | A * | 11/1941 | Smith | B21B 25/02 72/451 |
| 2,837,945 | A | 6/1958 | Griffiths | |
| 3,118,329 | A * | 1/1964 | Hendrickson | B21B 25/02 72/209 |
| 4,967,579 | A * | 11/1990 | Haydo | B23Q 1/76 72/428 |
| 2021/0031316 | A1 * | 2/2021 | Weingärtner | B23Q 1/58 |

FOREIGN PATENT DOCUMENTS

| | | | |
|---|---|---|---|
| DE | 3319809 | A1 | 12/1983 |
| JP | H0280108 | A | 3/1990 |
| RU | 1765955 | C | 4/1996 |
| RU | 2108176 | C1 | 4/1998 |

OTHER PUBLICATIONS

CN 108994083 A, Jun et al. Dec. 2018.*
CN 108838210 A, Dang et al. Nov. 2018.*
WO 2019006811 A1, Gu et al. Jan. 2019.*
JP 59-159205 A, Arai et al. Sep. 1984.*
Patent Cooperation Treaty, International Search Report and Written Opinion for International Application No. PCT/IB2020/057824, dated Nov. 27, 2020, 15 pages.

* cited by examiner

GUIDE DEVICE FOR GUIDING A DRIVING BAR OF A MANDREL OR FOR GUIDING A MANDREL IN A ROLLING PROCESS OF TUBULAR BODIES

CROSS-REFERENCE TO RELATED APPLICATIONS

This application claims priority to PCT International Application No. PCT/IB2020/057824 filed on Aug. 20, 2020, which application claims priority to Italian Patent Application No. 102019000014925 filed on Aug. 22, 2019, the disclosures of which are expressly incorporated herein by reference.

STATEMENT RE: FEDERALLY SPONSORED RESEARCH/DEVELOPMENT

Not applicable.

BACKGROUND OF THE INVENTION

Field of the Invention

The present invention falls within the scope of rolling plants of tubular bodies. More precisely, the invention relates to a device for guiding a mandrel or guiding a driving bar of a mandrel which can be employed for rolling tubular bodies. The invention also relates to a guide unit comprising at least one guide device according to the present invention.

Background Art

Processes are known for making hollow bodies (or tubular bodies) such as, for example, seamless tubes. A first process which is very well known in the field is the one called push bench, for example described in U.S. Pat. No. 2,083,698. Such a process consists in preforming a cup made of the material to be rolled and then pushing it through a series of rolling stands or matrixes having decreasing sections by means of a mandrel inserted in the cup. A reduction of the thickness with subsequent elongation of the tube itself is obtained due to the effect of the pressure exerted on the material during the passage thereof between the matrixes (or stands) and the mandrel itself. Conventionally, the cup from which the process starts is generally made from a suitably heated bloom. At the end of the rolling, the mandrel is separated from the rolled tube thus obtained. The end of the tube, called a cap, is cut before the tube continues along the successive passages during which the deformation (calibration, finishing) is completed.

Another process of the known type, known as the CPE (Cross Piercing and Elongation) process, consists in making a starting hollow body by piercing the bloom, inserting the mandrel into the hollow body and mechanically fastening the hollow body to the mandrel in the end area of the tip by means of local deformation called crimping. With respect to the push bench type of process, this second process allows improving the yield of the material while avoiding discarding the cap.

Both the above-indicated processes provide pushing the mandrel along the rolling mill by means of a driving bar placed at the back of the mandrel with respect to the advancement direction thereof. Conventionally, the nominal diameter (or caliber) of the driving bar coincides with the one of the mandrel to be pushed. In use, the diameter of the mandrel may be slightly greater than that of the bar pushing it due to the increased temperature. In any event, the mandrel is pushed by a greater length than the one of the mandrel itself. Considering, for example, the production of blanks having maximum length of 21 to 21.5 meters, the total length of the mandrel plus the driving bar overall exceeds 45 meters. The driving bar and mandrel assembly is subject to compression during the rolling and, due to the length, tends to result in a very narrow rod. Guide and containment systems are provided which keep the elements to be guided (bar and mandrel) aligned along the rolling direction to avoid the bending of bar and/or mandrel.

FIG. 1 is a schematization of a guide unit (100) which comprises a plurality of devices (hereinafter also indicated by the expression modules), each of which being equipped with sliding rules which are suitably shaped so as to minimize the movement/oscillation space of the mandrel and the bar during the operating stroke. In other words, the sliding rules form containment surfaces against which the element to be guided may rest during the movement thereof along the rolling axis. In the system in FIG. 1, a first section (100A) is identified in which there is arranged a first series of devices for guiding the driving bar and a second section (100B), which is downstream of the first with respect to the advancement direction of the bar itself, comprising a second series of devices. The devices of the second section (100B) in particular guide both the driving bar and the mandrel until the crossing of the latter in the rolling stand or matrix is complete. The modules of the second section (100B) are provided with means adapted to allow loading the mandrel in the section itself. The part of plant (not shown in FIG. 1) in which the actual rolling process occurs is positioned downstream of the second section (100B) of the unit (100). The two sections (100A, 100B) are configured so that the bar and the mandrel advance along a direction coinciding with the rolling direction (201).

FIGS. 2 to 4 are views of a guide device (hereinafter also indicated as guide module) known from the background art. Such a module comprises a support structure (110) which is anchored to the floor. The structure defines a movement plane (200) containing the rolling axis (201), which conventionally is horizontal. The support structure (110) comprises a first portion (111) and a second portion (112), which are arranged on opposite sides with respect to the movement plane (200). Each of the portions (111, 112) carries a rule (113, 114) in position which is opposite to the rule carried by the other portion with respect to the movement plane (200). The containment module further comprises an arm (150) rotating about a rotation axis (250) which is parallel to the movement plane (200). Such an arm (150) carries a third rule (115) which, in operating position, is arranged at the movement plane (200) and more precisely, so that the three rules (113, 114, 115) are substantially arranged at 120° from one another or in any case are distributed as homogeneously as possible along the perimeter of the body to be guided. The arm (150) rotates from the operating position to an open position which, when reached, may allow the mandrel (161) to be inserted. The same arm (150) is shown in FIG. 4 in the two positions described above. The guide module comprises hydraulic and/or mechanical locking means (not shown in FIG. 4) in order to keep the arm (150) in the operating position, and therefore to keep the mandrel forced between the three rules (113, 114, 115). With reference again to FIG. 4, when it is intended for the second section of the system (mandrel guide), the module comprises a slide (162) along which the mandrel (161) may roll to be positioned between the rules (113, 114) when the arm (150) is in the open position.

Again with reference to FIGS. 2 and 3, the support structure (110) defines a space (108) inside of which a head (280) to which the driving bar is connected, is free to move. More precisely, the head (280) moves parallel to the rolling axis by employing moving means (109), which conventionally are of the pinion-rack type.

As indicated above, due to the length of the bar-mandrel unit, the rolling plant comprises a significant number of these modules. Overall, the rules form a guide system which, during rolling, is subjected to considerable forces, impacts and vibrations. For this reason, the hydraulic locking means, and more generally all the fastening systems, are to be configured so as not to allow the disconnection of the rules. However, the rules are subjected to heavy wear due to the forces involved and the sliding on the surfaces thereof. Therefore, with respect to the significant length (also greater than 40 meters) of the guide unit, the costs associated with performing maintenance on and for replacing the worn rules are particularly significant, especially in those plants in which the use of mandrels with different diameter (also called caliber) is provided.

In this regard, FIGS. 2 and 3 show the same guide module equipped in a different manner to guide a mandrel having a predefined diameter. In particular, it is worth noting from the comparison between these two Figures how, as the diameter of the mandrel varies, the rules are necessarily to be replaced with other ones adapted to the purpose. This aspect also strongly affects the times and costs to be sustained for managing the plant, and therefore the final production costs. In fact, each time the diameter of the mandrel is changed or each time the rules are worn beyond a given value, the guide module is to be equipped again and operatively restored. In fact, in the current state, the times for preparing a guide device and operating on a new diameter are in the range of tens of hours.

Therefore, the need arises from the above-indicated considerations, to create a new guide system of the driving bar and/or of the mandrel which allows overcoming the above-mentioned drawbacks.

SUMMARY OF THE INVENTION

The main task of the present invention is the one of providing a guide device of a driving bar and/or of a mandrel which allows overcoming the above-indicated drawbacks. Within the scope of this task, it is an object of the present invention to provide a guide device which allows a reduction of the costs and the maintenance interventions associated with the wear of the guide surfaces. It is another task of the present invention to provide a functionally versatile guide device, i.e. which easily lends itself to guiding driving bars and/or mandrels having different diameter. It is a yet further object of the present invention to provide a guide device which is reliable and easy to manufacture at competitive costs.

The present invention is based on the general consideration of achieving the above-indicated objects by employing four abutment surfaces and arranging such surfaces on slides which are movable along a direction orthogonal to the advancement one of the bar or mandrel (hereinafter generically indicated as movable element). In particular, the device according to the invention comprises a support structure which identifies an advancement direction of the movable element to be guided. The support structure carries a first slide and a second slide, which are slidable along a transverse direction substantially orthogonal to the advancement direction. Each of the two slides carries two abutment surfaces for guiding the movable element and is movable along said transverse direction between at least a first operating position, upon reaching which said abutment surfaces are susceptible to coming into contact with a movable element having a first predefined diameter, and at least a second operating position, upon reaching which said abutment surfaces are susceptible to coming into contact with another movable element having a second predefined diameter; the device according to the invention comprises actuating means which move the slides along the transverse direction between the operating positions and then lock the slides themselves when one of said operating positions is reached.

The employment of two slides which are transversely movable with respect to the advancement direction of the element to be guided and the employment of four surfaces, on the one hand allows recuperating the wear of the abutment surfaces and on the other, adapting the device to the possible variation of the diameter of the mandrel. The operating position of the abutment surfaces becomes adjustable through the movable slides, and therefore adaptable to the diameter of the movable element to be guided.

According to a possible embodiment, the abutment surfaces of the first slide mirror the abutment surfaces of the second slide with respect to a vertical reference plane containing the advancement axis of the movable element. Preferably, the abutment surfaces for at least one of the slides extend over corresponding planes of extension which are tilted with respect to a horizontal reference plane containing the advancement direction (hereinafter also indicated by the expression "advancement axis"). The planes of extension are tilted by a same angle with respect to said reference plane and substantially intersect on the same reference plane so that the abutment surfaces substantially are arranged in a V. It has been see how this solution allows a particularly effective guide of the element, on the one hand because the contact surfaces are uniformly distributed about the advancement direction and on the other, they mirror one another two-by-two with respect to the vertical reference plane containing the same advancement direction.

According to a preferred embodiment, the actuating means comprise a first moving unit for the first slide and a second moving unit for the second slide. At least one of said units comprises an articulated mechanism configured to take on at least a first configuration which is characteristic of said first operating position and a second configuration which is characteristic of said second operating position. The actuating means further comprise thrust means for varying the configuration of said articulated mechanism. The employment of articulated mechanisms and corresponding thrust means allows a rapid movement of the two slides between the two operating positions and, therefore, device tooling times are significantly reduced.

According to a possible embodiment, the corresponding moving unit for at least one of the slides comprises a mechanical locking element which intervenes on the corresponding articulated mechanism, thus locking it in said second configuration and so that the configuration of said articulated mechanism can be varied only upon the actuation of said thrust means. The employment of a mechanical locking element is particularly advantageous in terms of reliability because the articulated mechanism may operate (i.e. keep the corresponding slide in the operating position) also in the event of failure or breakdown of the thrust means.

Preferably, the thrust means are connected to the connecting rod and comprise a hydraulic, pneumatic or electric type actuator.

In a possible embodiment, the mechanical locking element comprises an abutment surface against which the second lever of each pair of levers rests when said articulated mechanism takes on said second configuration.

According to a possible embodiment, at least one of said slides comprises a movable portion carrying a first abutment surface of said abutment surfaces; such a movable portion is movable between a closed position and an open position; when in said closed position, said first abutment surface is susceptible to contacting the movable element, and in which in said open position, said first surface occupies a position which is distal from the advancement axis such as to allow the positioning of the movable element in a housing space delimited by the other abutment surfaces.

In a possible embodiment, the movable portion is rotatable between the closed position and the open position about a rotation axis parallel to the advancement axis; the device comprises at least one rotation unit for rotating the movable portion between the closed position and the open one.

In a possible embodiment, the device comprises two rotation units installed on opposite end parts of said at least one of said slides, in which the end parts are assessed along a direction parallel to said advancement axis.

According to a possible embodiment, the rotation unit comprises:

- an articulated kinematism configured to take on at least a first configuration which is characteristic of said closed position and a second configuration which is characteristic of said open position of said movable portion;
- an operating element for varying the configuration of the kinematism from said first configuration to said second configuration, and vice versa.

Preferably, at least one of said rotation units comprises a mechanical locking element which acts on said articulated kinematism, thus locking it in said second configuration and so that the configuration of articulated kinematism can be varied only upon the actuation of said operating element.

According to a possible embodiment, the operating element comprises an actuator and said articulated kinematism comprises:

- a body hinged to said at least one slide and hinged to a rod of said actuator so that a translation of said rod corresponds to a rotation of the body;
- a lever hinged to said movable portion of the slide and hinged to the body so that upon a rotation of the body with respect to the at least one slide, the lever causes a rotation of the movable portion and therefore, depending on the direction, a passing from the closed position to the open one, or vice versa.

BRIEF DESCRIPTION OF THE FIGURES

Further objects and advantages of the present invention will become apparent from the following detailed description of an exemplary embodiment thereof and from the accompanying drawings, which are merely illustrative and non-limiting, in which.

The same numerals and reference letters in the Figures identify the same elements or components.

DETAILED DESCRIPTION

Figure 1:
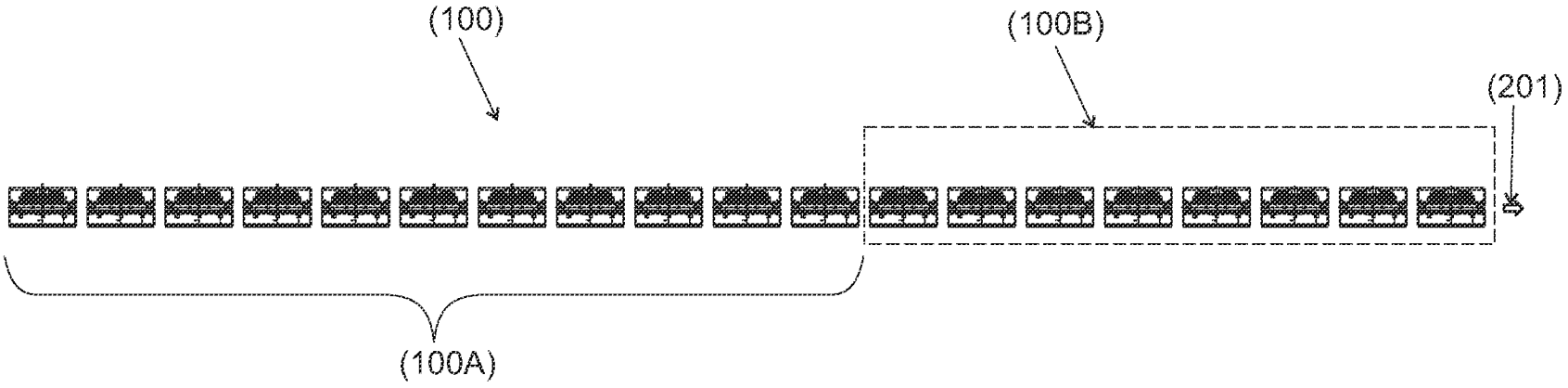
Fig. 1 PRIOR ART
FIG. 1 is a diagrammatic view of a plant of the known type.
Figure 3:
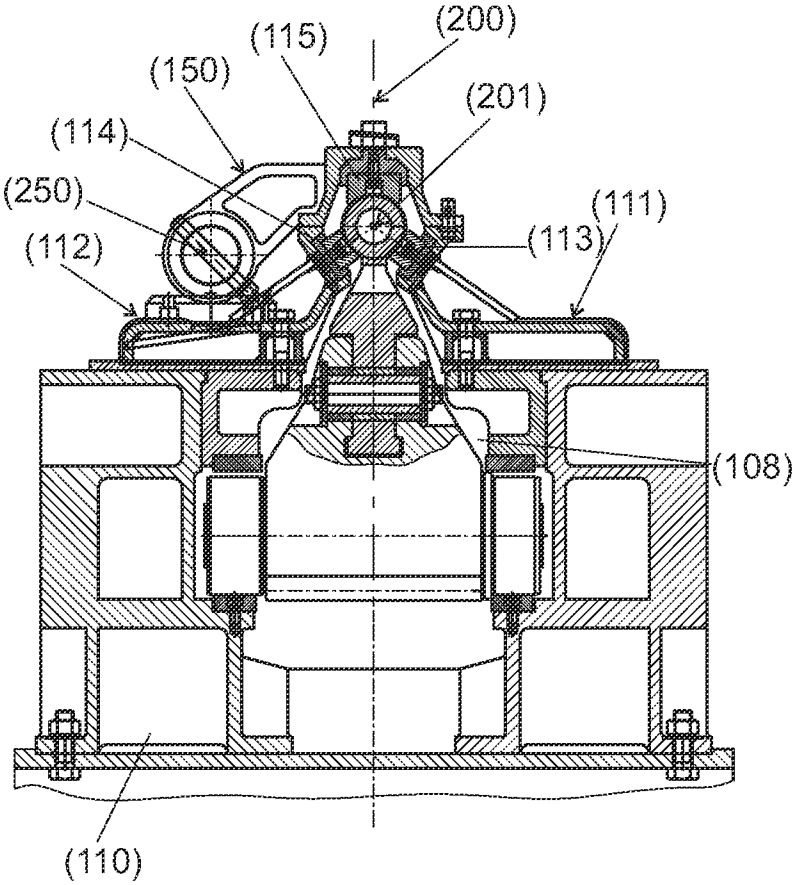
Fig. 3 PRIOR ART
FIGS. 2 and 3 are diagrammatic views of a guide device of a driving bar or a mandrel of the known type.
Figure 2:
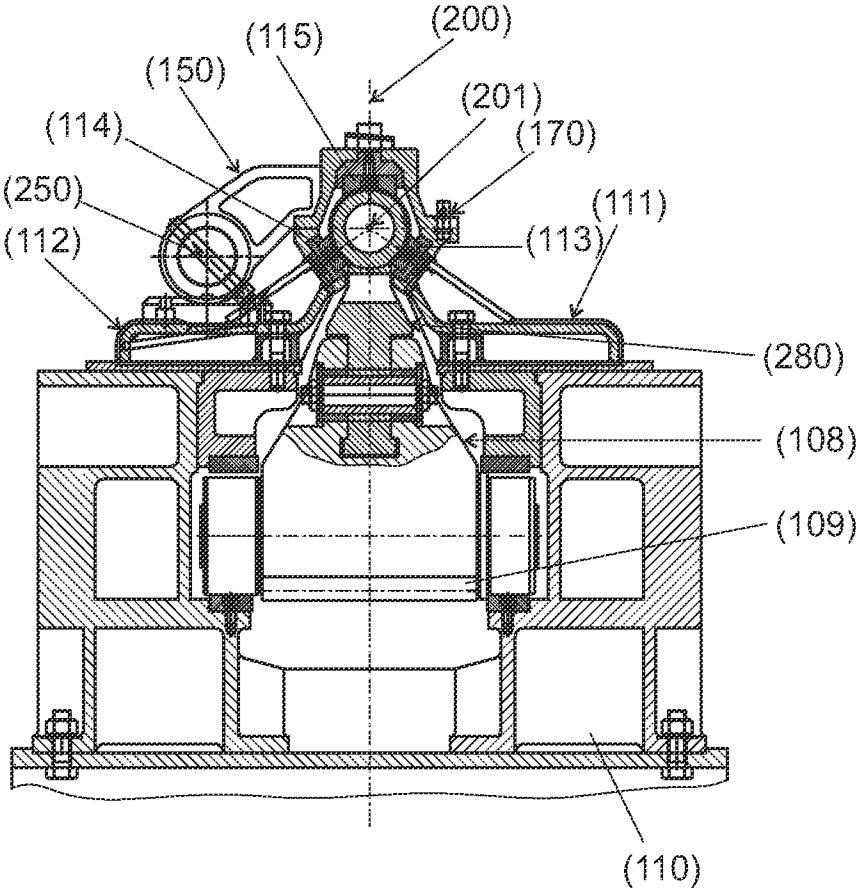
Fig. 2 PRIOR ART
Figure 4:
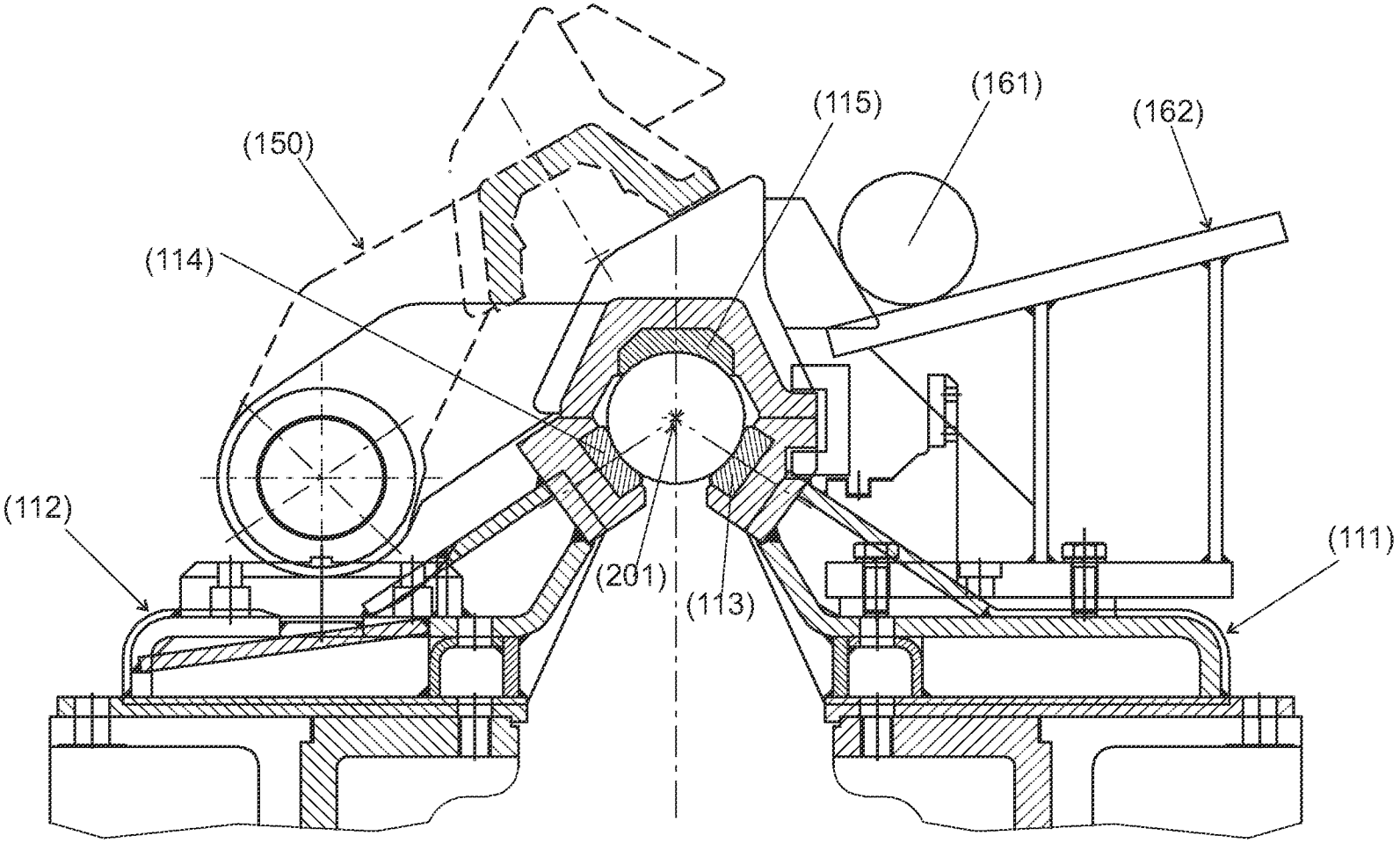
Fig. 4 PRIOR ART
FIG. 4 is a diagrammatic view of a known device of the known type, for guiding a mandrel.

With reference in particular to FIGS. 4 to 15A, the present invention relates to a device 1, 1A for guiding a driving bar 5 of a mandrel or for guiding a mandrel 6. Device 1, 1A comprises a support structure 10 defined by a first part 10A and by second part 10B, which are opposite with respect to a reference plane 200 on which the advancement axis 201 (hereinafter also indicated by the expression "advancement direction 201") of bar 5 and mandrel 6 acts. In the continuation of the description, bar 5 and mandrel 6 may also be indicated by the generic term "movable element 5-6".

Device 1 of the invention comprises a first slide 11 and a second slide 12, which are carried by said first part 10A and by said second part 10B of structure 10, respectively. More precisely, the two slides 11, 12 are slidable along a transverse direction 202, i.e. substantially orthogonal to the vertical reference plane 200 and to the advancement axis 201. The movement of the slides 11, 12 along the transverse direction 202 is defined by guides 4A, 4B which are carried by the two parts 10A, 10B of structure 10. In an embodiment shown in the Figures, two guides 4A, 4B are provided for each slide 11, 12.

According to the present invention, each of the two slides 11, 12 comprises two abutment surfaces 51, 52, 53, 54 for bar 5 and/or for mandrel 6, depending on the function for which device 1 is intended. More precisely, according to a first possible employment, the abutment surfaces 51, 52, 53, 54 serve to guide bar 5 alone, while in a second possible embodiment, the surfaces 51, 52, 53, 54 guide mandrel 6 and bar 5 in sequence. In any event, each abutment surface 51, 52, 53, 54 serves the function of guiding the movable element (bar and/or mandrel) and of countering the bending/deformation to which the element itself is subjected due to the loads weighing thereon.

According to the invention, each of the slides 11, 12 is movable along the transverse direction 202 between a first operating position, upon reaching which the abutment surfaces 51, 52, 53, 54 are susceptible to coming into contact with a movable element having a first predefined diameter, and a second operating position, upon reaching which the abutment surfaces 51, 52, 53, 54 are able to come into contact with a movable element having a second predefined diameter which is different from said first predefined diameter. In other words, according to the invention, each operating position of the slides 11, 12 is characteristic of a predefined diameter of the movable element 5-6.

According to the invention, device 1 comprises actuating means of the slides 11, 12 which move each slide 11, 12 between said operating positions and lock each slide 11, 12 when one of said operating positions is reached. Therefore, the actuating means serve the function of obtaining the movement of the slides 11, 12 along the transverse direction 202 from said first operating position to said second operating position, and vice versa. At the same time, the actuating means are configured to lock the slides 11, 12 when the same reach one of the operating positions so that the abutment surfaces 51, 52, 53, 54 effectively counter the bending loads to which the movable element (bar 5—mandrel 6) is subjected.

Due to the effect of the movement of the slides 11, 12 along the transverse direction 202, device 1 advantageously allows movable elements having at least two different diameters to be guided without the need to perform any tooling or modify the configuration of the device.

The actuating means could be configured to allow the abutment surfaces 51, 52, 53, 54 to also reach further operating positions, each characteristic of a predefined diameter of the movable element 5-6 to be guided. The possibility also falls within the scope of the present invention, of configuring the actuating means so that the same allow the slides 11, 12 to be positioned in any position comprised between two limit positions which are characteristic of a maximum diameter and a minimum diameter of a movable element 5-6 to be guided. In other words, the possibility falls within the present, of continuously adjusting the position of the two slides 11, 12 when such a position is comprised between the two limit positions defined above.

According to a preferred embodiment of the invention, the at least two abutment surfaces 51-52 of the first slide 11 mirror the abutment surfaces 53-54 of the second slide 12 with respect to a vertical reference plane 200 containing the advancement axis 201.

According to a possible embodiment (clearly shown in FIG. 7), the corresponding abutment surfaces 51, 52, 53, 54 for each of the slides 11, 12 extend over planes of extension 501, 502, 503, 504 which are tilted with respect to a horizontal reference plane 500 containing the advancement axis 201. Preferably but not exclusively, the corresponding planes of extension 501-502, 503-504 for each slide 11, 12 are tilted by a same angle ($\alpha 1=\alpha 2$) but are opposite with respect to the horizontal reference plane 500. The arrangement of the abutment surfaces 51, 52, 53, 54 is such that the planes of extension 501, 502, 503, 504 intersect at the reference plane 500. Basically, the two surfaces 51-52, 53-54 for each slide 11, 12 are substantially arranged in a V with the vertex substantially on the reference plane 500. It has been shown that also this particular arrangement of the abutment surfaces 51, 52, 53, 54 contributes to the functional versatility of device 1, 1A according to the invention. Indeed, such an arrangement allows the abutment surfaces 51, 52, 53, 54 to adapt to the variation in diameter of mandrel 6 and/or bar 5 in any case so as to provide four abutment/contact points.

According to a possible alternative embodiment to the one above, with respect to the horizontal reference plane 500, the abutment surfaces 51, 53 arranged below the horizontal reference plane 500 might not mirror the abutment surfaces 52, 54 arranged above the same plane ($\alpha 1 \neq \alpha 2$). The inclination angle $\alpha 2$ of the planes of extension 501-503 of the abutment surfaces 51, 53 below the reference plane 500, for example could be less than the inclination angle $\alpha 1$ of the planes of extension 502-504 of the surfaces above the same reference plane 500. This arrangement could depend, for example, on the dimensions of head 280, which carries and pushes bar 5, as better indicated below. In any case, the possibility falls within the invention for the abutment surfaces 51-53, 52-54 to be arranged in substantially opposite manner to what is indicated above, i.e. angle $\alpha 2$ is greater than angle $\alpha 1$.

Figure 7:
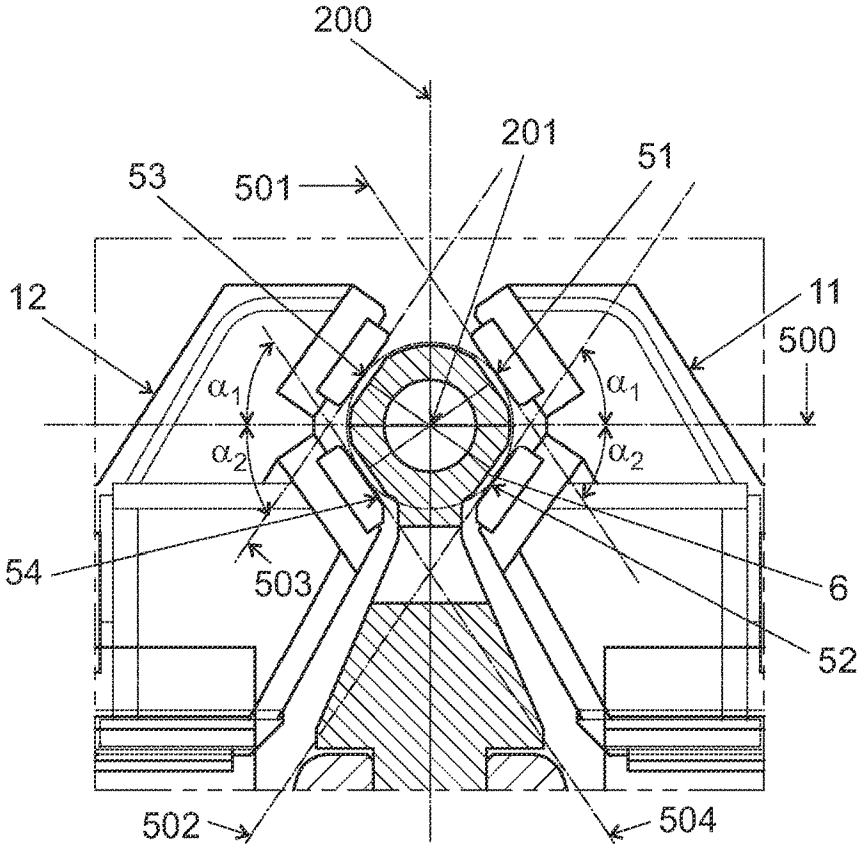
FIG. 7 is an enlargement of the detail VII indicated in FIG. 5.
Figure 7A:
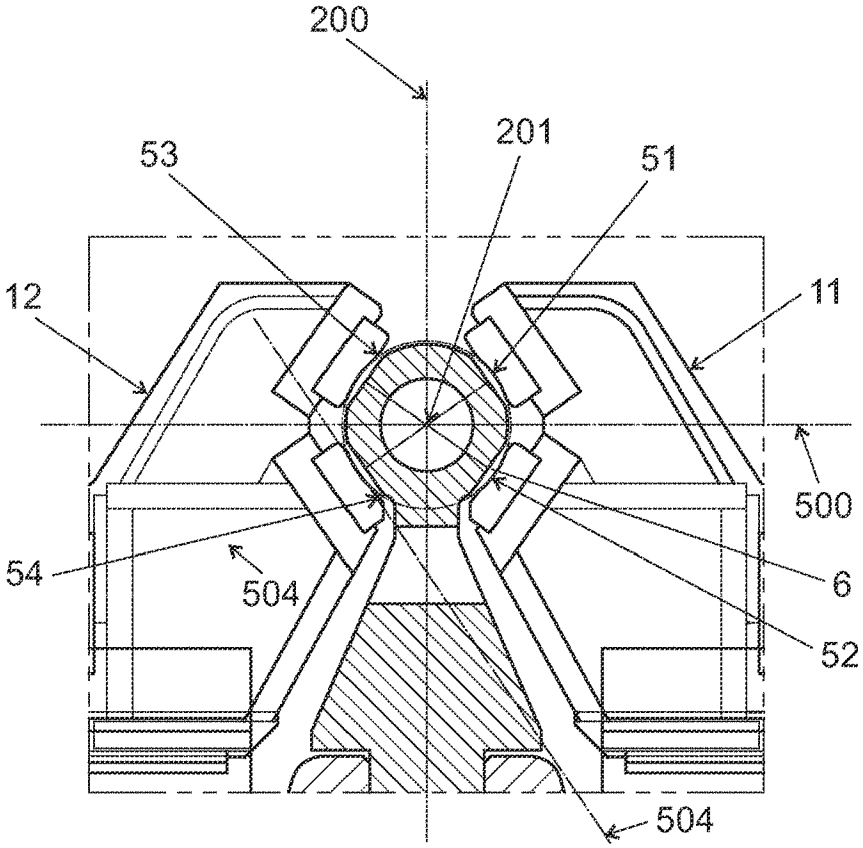
FIG. 7A is a view related to an alternative embodiment of the detail VII shown in FIG. 5.

According to another embodiment, shown in FIG. 7A, the abutment surfaces 51, 52, 53, 54 could also have a concave shape with a radius of curvature which is greater than or equal to the radius of the guide element 5-6. According to a further embodiment, two abutment surfaces could extend over a plane, while two others could be concave.

Therefore, not only do the embodiments described above for the abutment surfaces fall within the scope of the present invention, but so do combinations thereof or again, further alternative embodiments which are functional for the purpose. In this regard, the abutment surfaces arranged above the horizontal reference plane 500 may mirror or not mirror the ones below the same plane.

According to a possible embodiment, device 1, the actuating means comprise, for each of the slides 11, 12, a moving unit 301, 302 for moving a corresponding slide 11, 12 from the first operating position to the second operating position (or vice versa). In particular, according to the invention, such a moving unit 301, 302 comprises an articulated mechanism 21, 22 which takes on at least a first configuration which is characteristic of said first operating position and a second configuration which is characteristic of said second operating position of the corresponding slide 11, 12. The moving unit 301, 302 further comprises thrust means 88 for varying the configuration of the articulated mechanism 21, 22, in particular between the two configurations (first and second) described above. It is precisely the variation in configuration of the articulated mechanism 21, 22, induced by the thrust means 88, to translate into the movement of the corresponding slide 11, 12 along the transverse direction 202 between the two operating positions.

Figure 8:
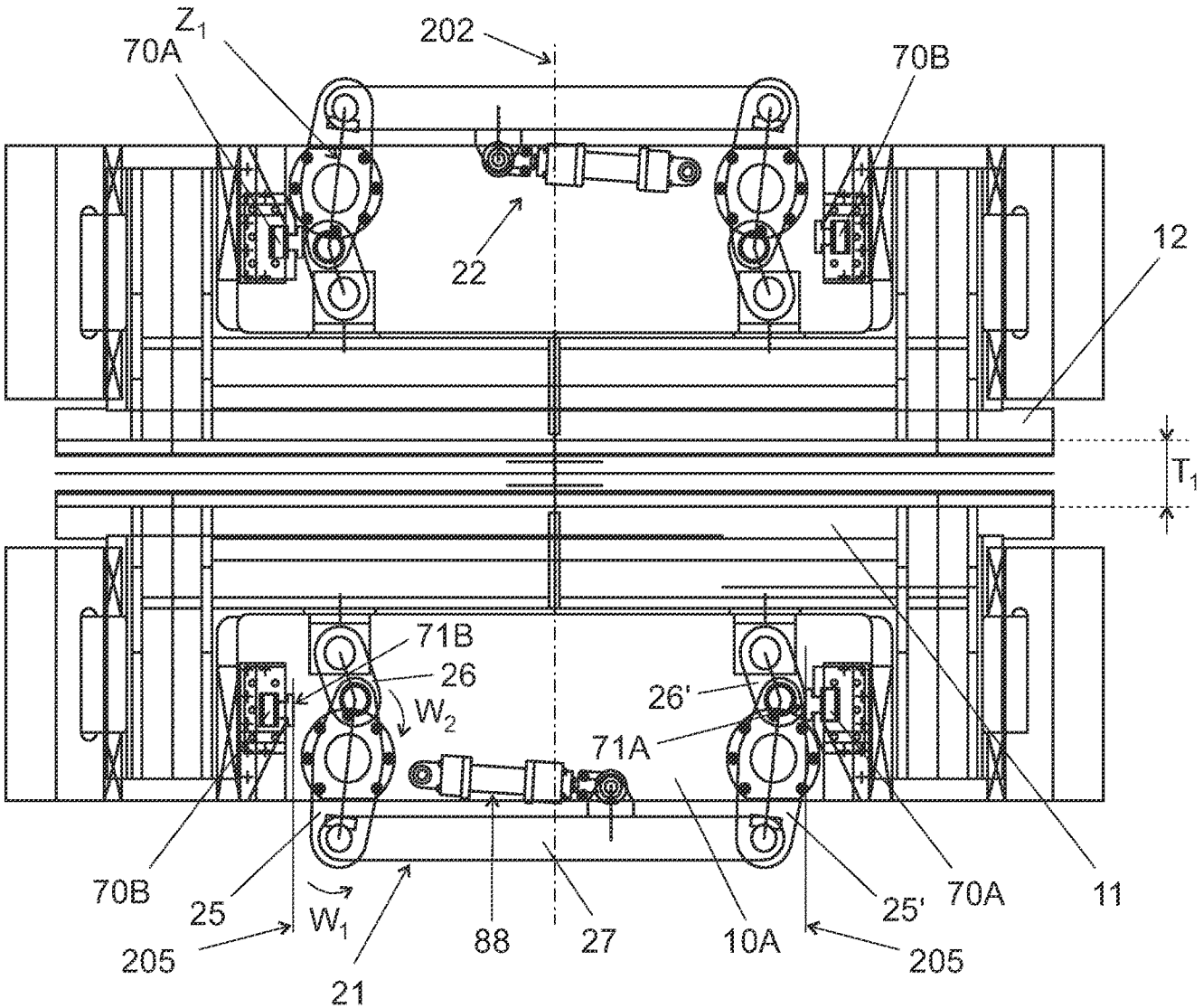
FIGS. 8 and 9 are views of the device in FIG. 5 in a first and second operating configuration, respectively.
Figure 9:
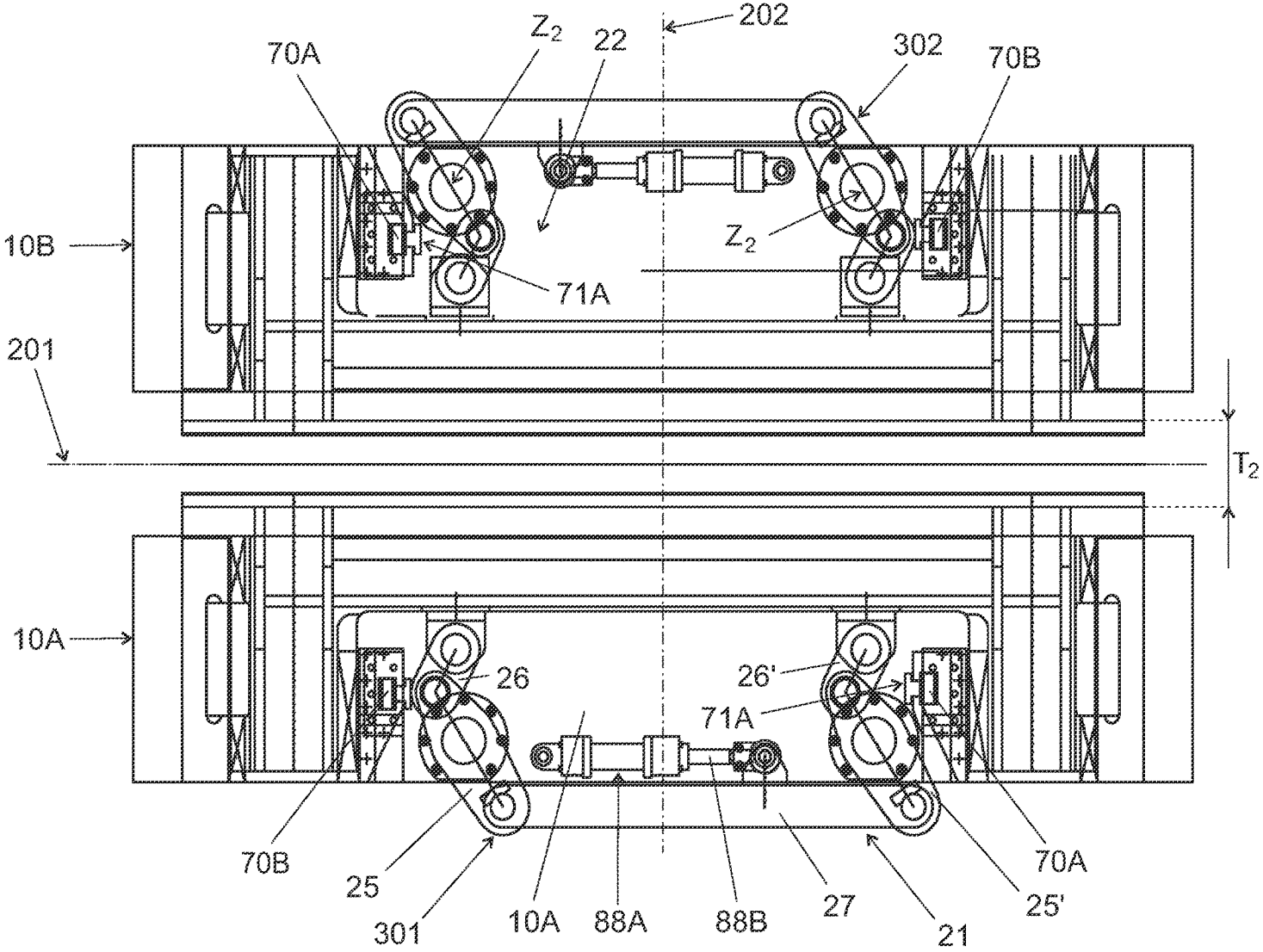
Figure 10:
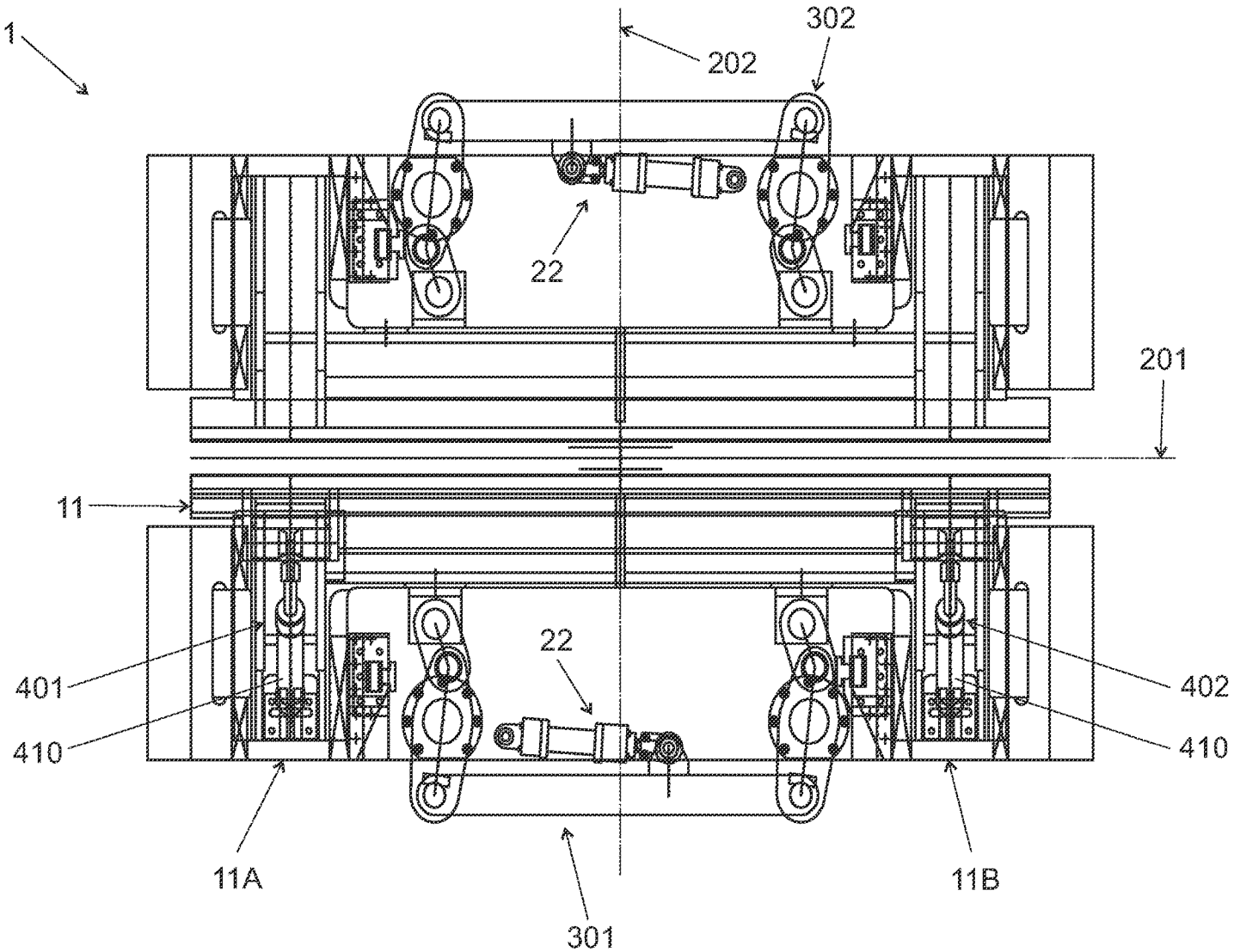
FIG. 10 is a further view of the device in FIG. 6.

In this regard, FIGS. 8 to 10 show a possible, and therefore not exclusive, embodiment of the two moving units 301, 302 according to the invention. In particular, FIGS. 8 and 9 are plan views of device 1 in FIG. 5 and allow the shape of the articulated mechanisms 21, 22 of each moving unit 301, 302 to be noted in each of the two operating configurations defined above. More precisely, FIG. 8 shows the articulated mechanism 21, 22 of each slide 11, 12 in the first operating configuration (slides 11, 12 in the first operating position), while FIG. 9 shows the same articulated mechanism 21, 22 in the second operating configuration (slides 11, 12 in the second operating position).

The articulated mechanism 21 of the first moving unit 301 comprises a first pair of levers 25, 26 and a second pair of levers 25', 26'. For each pair of levers, a first lever 25, 25' is hinged to the first part 10A of the support structure 10, while a second lever 26, 26' is hinged to the corresponding first lever 25, 25' and to the first slide 11. The articulated mechanism 21 also comprises a connecting rod 27 which connects the first lever 25 of the first pair of levers to the first lever 25' of the second pair of levers. The connecting rod 27 serves the function of synchronizing the rotation of the two levers 25, 25'. Such a rotation translates into a translation of the first slide 11 along the transverse direction 202 due to the effect of the guide means which restrain the movement of the first slide 11. In the embodiment shown in the Figures, the thrust means 88 are connected to the connecting rod 27 and comprise an actuator, preferably of the hydraulic type. The body 88A of actuator 88 is anchored to the first support part 10A, while the end of the rod 88B thereof is restrained to the connecting rod 27. The related movement of rod 88B with respect to body 88A of the actuator itself causes a roto-translation of the connecting rod 27 and a subsequent rotation of the two levers 25, 25'. In an embodiment not shown in the Figures, the thrust means 88 could be connected to another lever of the articulated mechanism.

As shown in FIGS. 8 and 9, the moving unit 302 selected to move the second slide 12 has a structure substantially corresponding to the one of the moving unit 301 described above. Therefore, what is disclosed above in reference to the moving unit 301 of the first slide 11 is to be considered entirely valid also for the moving unit 302 of the second slide 12.

According to a first possible embodiment, locking the slides 11, 12 in the first operating position or in the second operating position could be actuated directly by the thrust means 88. The hydraulic actuator mentioned above could therefore be configured so as to exert a sufficient force to keep the corresponding slide 11, 12 in the operating position reached previously due to the effect of the thrust exerted by the actuator itself.

According to a preferred embodiment of the invention, the related moving unit 301, 302 for each of the two slides 11, 12 comprises a first mechanical locking element 70A and a second mechanical locking element 70B which act on the articulated mechanism 21, 22, locking it in a corresponding operating configuration (i.e. locking the slide in the corresponding operating position) and therefore preventing any variation in configuration potentially caused by the forces acting on mandrel 6 or bar 5. In other words, each mechanical locking element 70A, 70B serves the function of preventing the corresponding slide 11, 12 from moving from the occupied operating position, unless such a movement is induced by the above-indicated thrust means 88.

In the embodiment shown in FIGS. 8 and 9, each mechanical locking element 70A and 70B comprises an abutment surface 71A, 71B which extends over a plane 205 which is substantially parallel to the transverse direction 202. With reference to FIG. 8, when the articulated mechanism 21, 22 occupies the first operating position, the second lever 26 of one of said pairs of levers 25-26 rests against the abutment surface 71A of a first mechanical locking element 70A. With reference to FIG. 9, when the articulated mechanism 21, 22 instead occupies the second operating position, the second lever 26 of the other of said pairs of levers rests against the abutment surface 71B of the second mechanical locking element 70B.

In any case, each abutment surface 71A, 71B prevents the rotation of the corresponding second lever 26, 26' which would be induced by the forces acting on the movable element 5-6. Such forces indeed would tend to move the corresponding slide 11, 12 away from the advancement axis 201, along the transverse direction 202, and therefore to vary the configuration of the articulated mechanism 21, 22. Advantageously, these forces are instead discharged onto the abutment surface 71A and therefore onto the support structure 10. In fact, due to the effect of the abutment surface 71A, the articulated mechanism 21 22 is auto-locked in the second operating configuration. This condition increases the reliability of device 1 according to the invention because locking the slides 11, 12 in the operating position is of mechanical type and therefore is not designated to the means pushing the slides 11, 12 along the transverse direction 202 (i.e. to the thrust means 88). The guiding of the movable element 5-6 is thus ensured also in the event of the breakdown or failure of the thrust means 88. This results in the latter being sized only to vary the configuration of the articulated mechanism 21, 22, i.e. to push the corresponding slide 11, 12.

With reference again to FIGS. 8 and 9, the following is a description of the moving principle of the two slides 11, 12 of the device shown. The slides 11, 12 in FIG. 9 occupy the second operating position. It is worth noting that in this configuration, the rod 88B of actuator 88 is substantially retracted in the body of the actuator itself. Due to the effect of the connecting rod 27, the levers of each pair of levers 25-26 and 25'-26' have the same angular position assessed with respect to the respective rotation axes. In particular, it is worth noting that the rotation axes of the levers 25-26 and 25'-26' for each pair of levers are not aligned in the first operating position, rather they identify a first broken line Z1 passing through the rotation centers of the levers themselves.

The actuation of actuator 88, i.e. the exit of rod 88B thereof, causes a movement of the connecting rod 27 and therefore a synchronized rotation of each pair of levers 25-26 and 25'-26'. With reference to FIG. 8, the first lever 25, 25' for each pair of levers 25-26 and 25'-26' rotates in counterclockwise direction (arrow $W_1$ in FIG. 8) about the rotation axis thereof, thus causing a rotation in clockwise direction (arrow $W_2$ in FIG. 8) of the corresponding second lever 26, 26'. The movement of the levers is completed until the corresponding slide 11, 12 reaches the second operating position (FIG. 9), in which the second lever 26' comes into contact with the abutment surface 71B of the second mechanical locking element 70A, thus locking the articulated mechanism 21, 22 in the configuration reached. It is worth noting that the rotation axes of the levers 25-26 and 25'-26' for each pair of levers 25-26 and 25'-26' are also not aligned in the first operating position, rather they identify a second broken line Z2, which is different from the first one (Z1), passing through the rotation centers of the levers themselves. It is also worth noting that the corresponding two levers for each pair of levers 25-26 and 25'-26' take on an intermediate position in the passage between the second operating position and the first operating position, whereby said rotation axes are aligned.

The variation of the existing distance (from $T_1$ to $T_2$) between the two slides 11, 12 (distance assessed along the transverse direction 201) following the movement from the second operating position to the first operating position may be noted from the comparison between FIGS. 8 and 9. Distance $T_1$, $T_2$ is assessed with respect to two points of the slides 11, 12 which mirror the vertical reference plane 200 containing the advancement axis 201. In the configuration shown in FIG. 8, such a distance $T_1$ is less than distance $T_2$ assessed in the second operating position. It is apparent that the value of the distance depends on the configuration of the levers 25-26 and 25'-26', and more generally of the articulated mechanism 21, 22.

FIGS. 8 and 9 show how device 1 is easily adapted to operate on movable elements 5-6 having at least two different nominal diameters. In particular, not only does the above-described embodiment allow a quick passage from one operating configuration to the other, but simultaneously allows the self-locking of the slides 11, 12 in each of the two operating positions following the change in configuration of the articulated mechanism 21, 22.

Advantageously, in the above-described embodiment shown in the Figures, device 1 according to the invention may be adapted to operate on movable elements 5-6 having a diameter which falls in a range (at least in the order of millimeters) around the nominal diameters which are characteristic of the mentioned operating positions. Such an adaptation may be completed by varying the thickness of the abutment surfaces 71A, 71B of the locking elements 70A, 70B, or more generally, by varying the position of the same abutment surface 71A, 71B (i.e. of plane 205 over which such a surface extends) along a direction which is parallel to the advancement axis 201. In essence, by modifying the position of the abutment surface 71A, 71B, the course of the broken line Z1-Z2 identified by the rotation axes of the levers may be varied when a corresponding operating position is reached.

It therefore is worth noting that the variation in thickness of the abutment surface 71A, 71B, or the variation of the longitudinal position thereof, in fact is the only operation required to adapt device 1, 1A to guide a movable element 5-6 having a nominal diameter close to the value of one of the nominal diameters. Therefore, with respect to the background art, device 1, 1A is much more adaptable and therefore easier to manage. Such a versatility results in a significant decrease in the dead times and therefore, in an increase of the plant productivity in which device 1, 1A itself operates.

According to a possible embodiment (shown also in FIG. 6), the first slide 11 comprises a portion 13 carrying one of said abutment surfaces (hereinafter indicated as first abutment surface 51), which is movable, preferably rotatable, between a closed position and an open position. In this embodiment, the device according to the invention is indicated by 1A and preferably is used for guiding a mandrel 6, it in any case being able to be used also for guiding a bar 5.

In the closed position, the first abutment surface 51 (carried by portion 13) is positioned in the position adapted to guide the movable element 5-6. Basically, in the closed position, the first abutment surface 51, with the other abutment surfaces 52, 53, 54, delimits the housing space SP (indicated in FIG. 13) in which mandrel 6 is positioned. In the open position, the abutment surface 51 is positioned in distal position from the other abutment surfaces 52, 53, 54 so as to define an opening which is useful for loading mandrel 6 in the housing space SP. The latter in any case remains defined by the other three abutment surfaces 52, 53, 54. Basically, portion 13 is made movable to allow the loading/insertion of mandrel 6 in the housing space. As indicated below, this operation may be carried out through mechanical arms or using a loading slide.

According to a preferred embodiment, the movable portion 13 is rotatable between the closed position and the open one about a longitudinal axis 220 which is parallel to the advancement direction 201. In this regard, device 1 according to the invention comprises at least one rotation unit 401, 402 for rotating said first movable portion 13 between the closed position and the open position.

According to a possible embodiment shown in FIG. 10, device 1 comprises two rotation units 401, 402 installed on opposite end parts of the first slide 11, when such end parts 11A, 11B are assessed along the advancement direction 201. It is worth noting that the device shown in FIG. 10—in essence corresponding to the one shown in FIGS. 8 and 9 minus the rotation units 401, 402 of the first portion 13—apparently is not in the device in FIGS. 8 and 9. The device in FIGS. 8-9 therefore preferably is intended to guide bar 5 which does not need to be loaded in device 1 because it is pushed ahead or pulled back along the advancement direction 201 by the thrust and dragging means, for example of the type known from the background art.

Preferably, the two rotation units 401, 402 have the same configuration. According to a preferred embodiment shown in FIGS. 11 and 12, each rotation unit 401, 402 comprises at least one articulated kinematism configured to take on at least a first configuration which is characteristic of said closed position and a second configuration which is characteristic of said open position of said movable portion 13. The following is a description of the shape of the first rotation unit 401, but the following considerations are true mutatis mutandi also for the second rotation unit 402.

The first rotation unit 401 also comprises an operating element 410 for varying the configuration of the kinematism from the first configuration to the second configuration, and vice versa. The operating element 410 preferably is an actuator of the hydraulic, pneumatic or electric type operatively connected to one of the members of the kinematism so as to vary the position thereof, thus inducing the configuration change. The operating element 410 is installed on the first slide 11 and remains integral with the slide itself, together with the whole kinematism, obviously during the movement along the transverse direction 202 from the first operating position to the second operating position, and vice versa.

With reference again to FIGS. 11 and 12, in a preferred embodiment of the first rotation unit 401, the articulated kinematism comprises a body 61 hinged to the first slide 11, preferably so as to rotate about a first rotation axis 451 parallel to the rotation axis of the movable portion 13. The operating element 410 is connected to the body 61 in order to cause the rotation about the first rotation axis 451. Body 61 preferably is hinged at a second rotation axis 452 at the rod of the actuator forming the operating element 410 so that a rotation of body 61 corresponds to a translation of the rod.

The kinematism also comprises a lever 62 hinged to the movable portion 13 of the first slide 11 and hinged to body 61 at a third rotation axis 453 and a fourth rotation axis 454, respectively. A rotation, through lever 62, of body 61 about the first rotation axis 451, induced by the operating element 410, translates into a rotation of the movable portion 13 about the longitudinal axis 220, and therefore depending on the direction, into a passage from the closed configuration (FIG. 11) to the open configuration (FIG. 12), or vice versa.

Figure 11A:
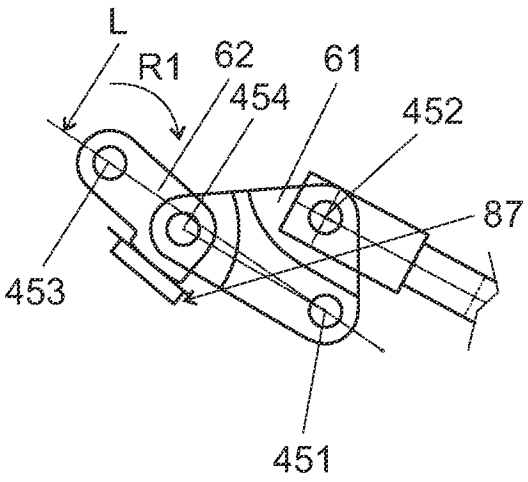
FIG. 11A is a detailed view of certain components shown in FIG. 11.
Figure 11:
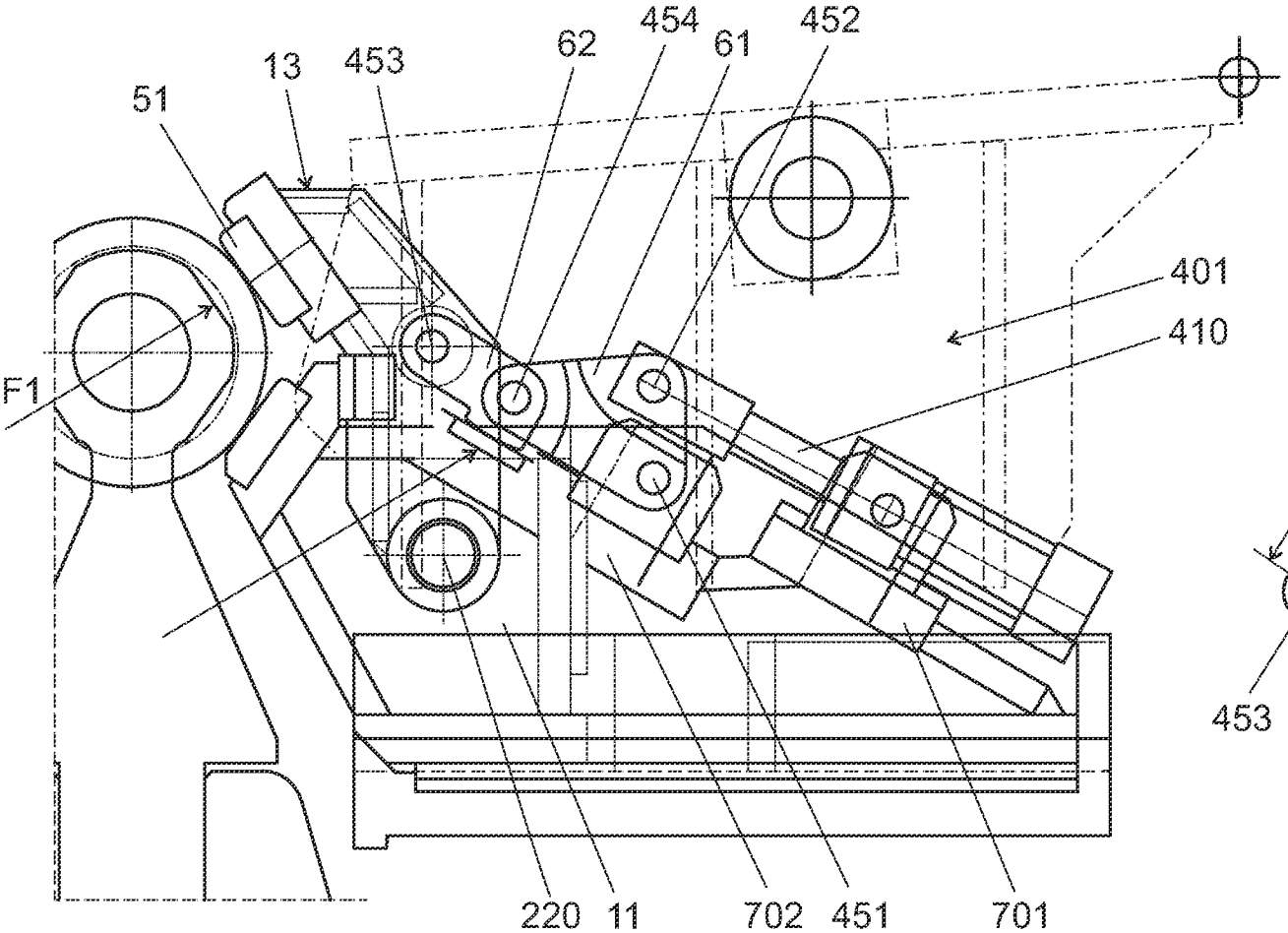
FIG. 11 is a view related to a possible operating configuration of an articulated kinematism of the device in FIG. 6.

With reference to FIG. 11, in the closed configuration, lever 62 comes into contact—with a part thereof close to the fourth rotation axis 454—an abutment surface 87 which is integral with structure 10. In such a configuration, the fourth rotation axis 454 is not positioned along direction L joining the first rotation axis 451 and the third rotation axis 453, rather it is in a position which is misaligned with such a joining direction. This condition is clearly shown in the diagrammatic view in FIG. 11A, in which the contact between lever 62 and the abutment surface 87 is noted. This contact prevents possible rotations (indicated by arrow R1 in FIG. 11A) of the movable portion 13 induced by the forces acting on mandrel 6 during the guiding thereof. Indeed, a possible radial force (indicated by F1 in FIG. 11) on the abutment surface 51 would result in the movable portion 13 rotating (in counterclockwise direction) about the longitudinal axis 220. The abutment surface 87 prevents such a rotation because it locks the rotation of the second lever 62 and accordingly, of the same movable portion 13. In fact, the contact between lever 62 and the abutment surface 87 causes the kinematism to be self-locking in the closed position. The abutment surface 87 forms a mechanical locking element which prevents varying the configuration thereof once the position corresponding to the closed position is reached unless there is an intervention by the operating element 410.

With reference again to FIGS. 11 and 12, following the actuation of the operating element 410 (in particular, following the retraction of the rod of the actuator), body 61 rotates in clockwise direction about the first rotation axis 451, thus causing the roto-translation of lever 62. The latter drags the movable portion 13 of slide 11, thus causing the rotation about the longitudinal axis 220. It is worth noting in the case in FIG. 11 that lever 62, dragged in rotation by body 61, rotates in counterclockwise direction about the third rotation axis 453 and causes the rotation of the movable portion 13 about the longitudinal axis 220. In particular, due to the effect of the dragging of body 61 and of the position taken on by the fourth rotation axis 454 (misalignment with respect to direction L), the movable portion 13 initially rotates (about axis 220) by a few degrees in counterclockwise direction towards the housing space SP and then in clockwise direction (again about axis 220) so as to free the access to the housing space SP.

As indicated above, the rotation of the movable portion 13 from the closed position to the open one is in order to allow the loading of mandrel 6 in the housing space SP. For this reason, it is carried out in the absence of a mandrel or during the dragging back of bar 5, i.e. under a condition which in any case also allows the initial rotation in clockwise direction towards the housing space.

Figure 12:
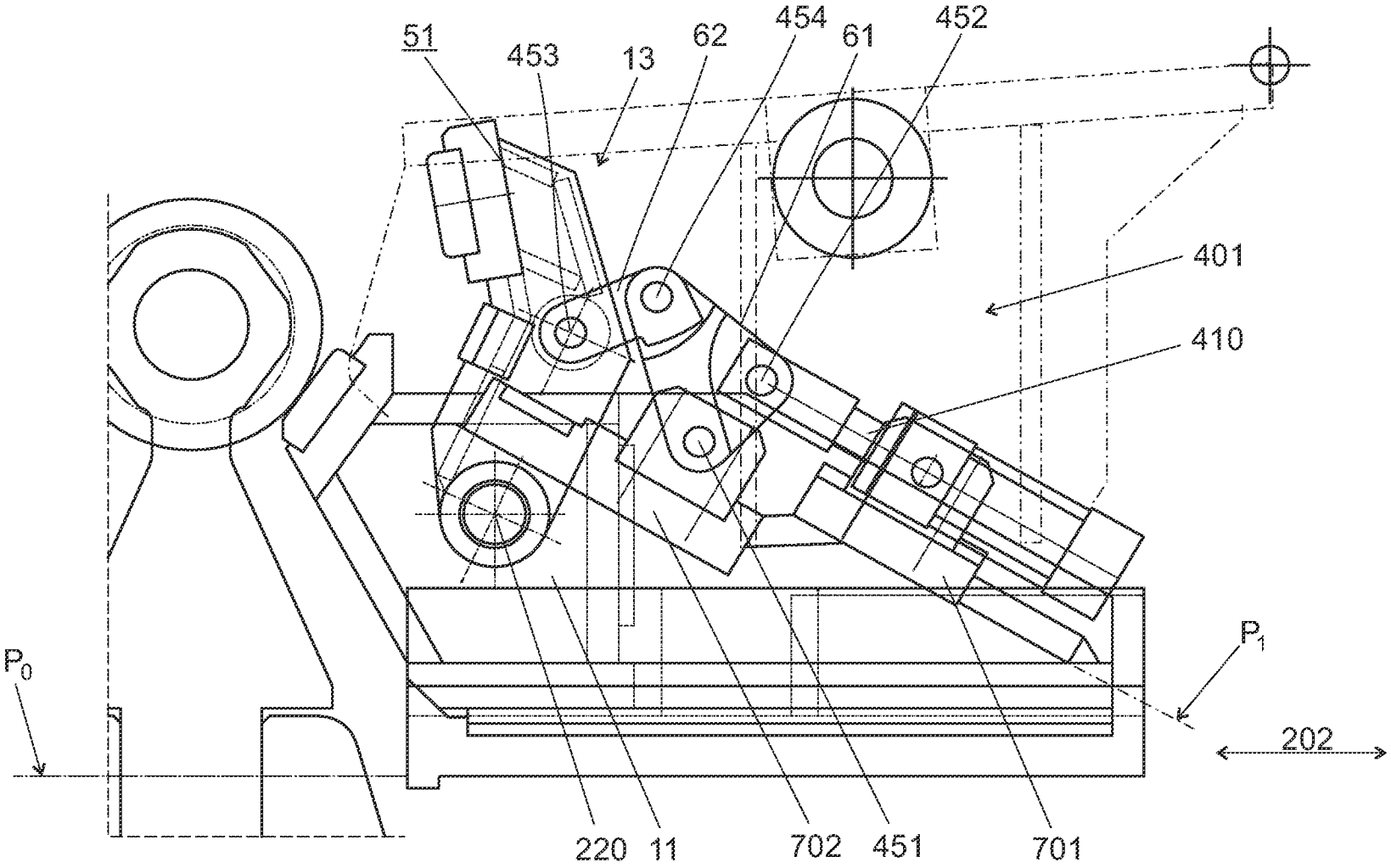
FIG. 12 is a view related to another possible operating configuration of the articulated kinematism in FIG. 11.

Again, it is worth noting from FIGS. 11 and 12 that the components of the articulated kinematism of the rotation unit 401 are installed on a plane P1 which is substantially tilted with respect to the movement plane P0 on which slide 11 moves (transverse direction 202). In any case, the possibility for the articulated kinematism to be configured in a different manner from the one described, and in any case installed on slide 11 according to a different arrangement from the one shown in the Figures, falls within the scope of the present invention.

Again with reference to FIGS. 11 and 12, it is worth further noting that the components of the kinematism (the operating element 410 and the abutment surface 87, in particular) are installed on blocks 701, 702 connected to slide 11 through removable connecting elements (not shown). Also this technical solution is only a possible, and therefore not exclusive, embodiment of the invention.

Figure 13:
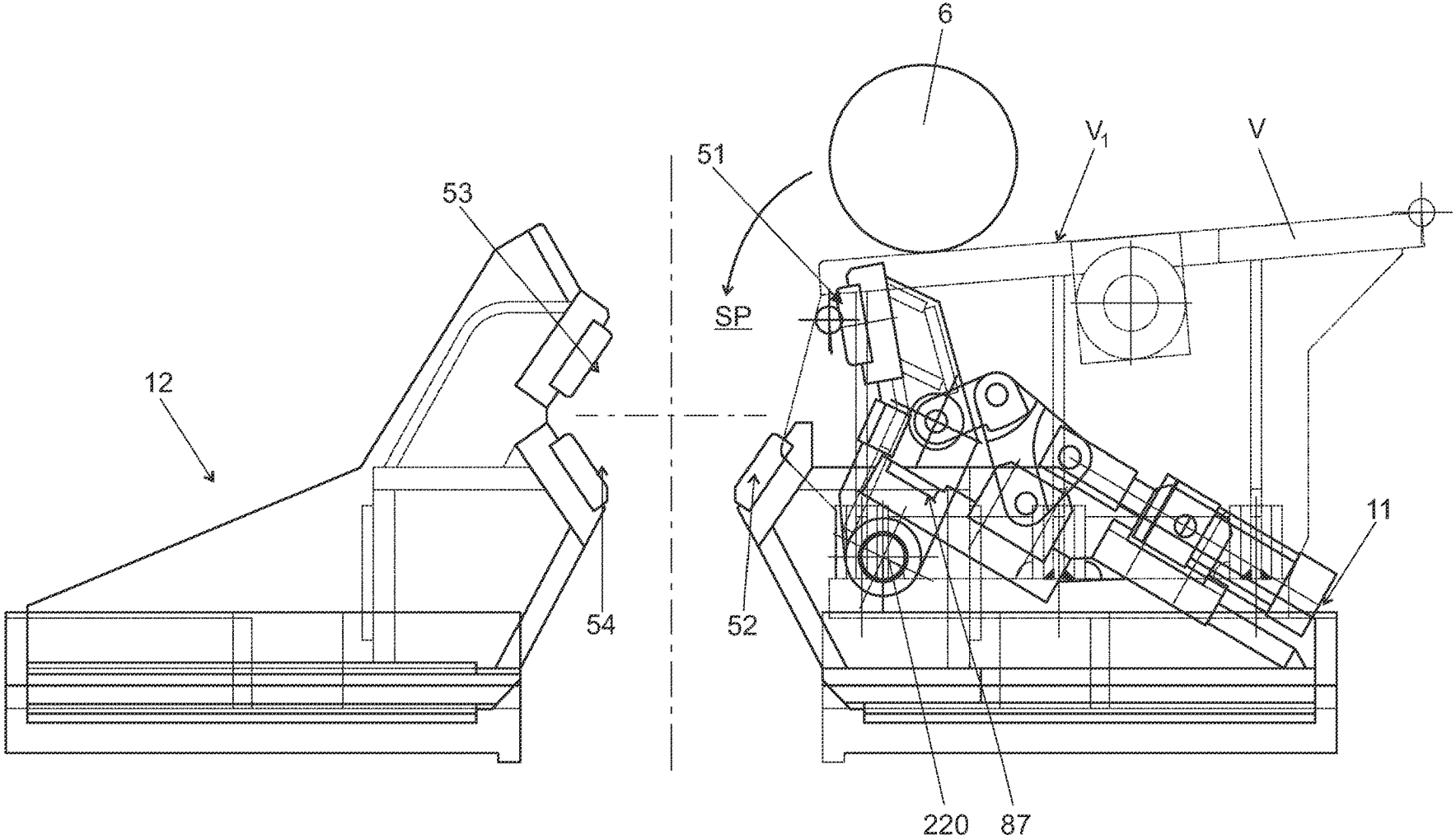
FIGS. 13 and 14 are views of an assembly of components of the device in FIG. 6, during various operating steps.
Figure 14:
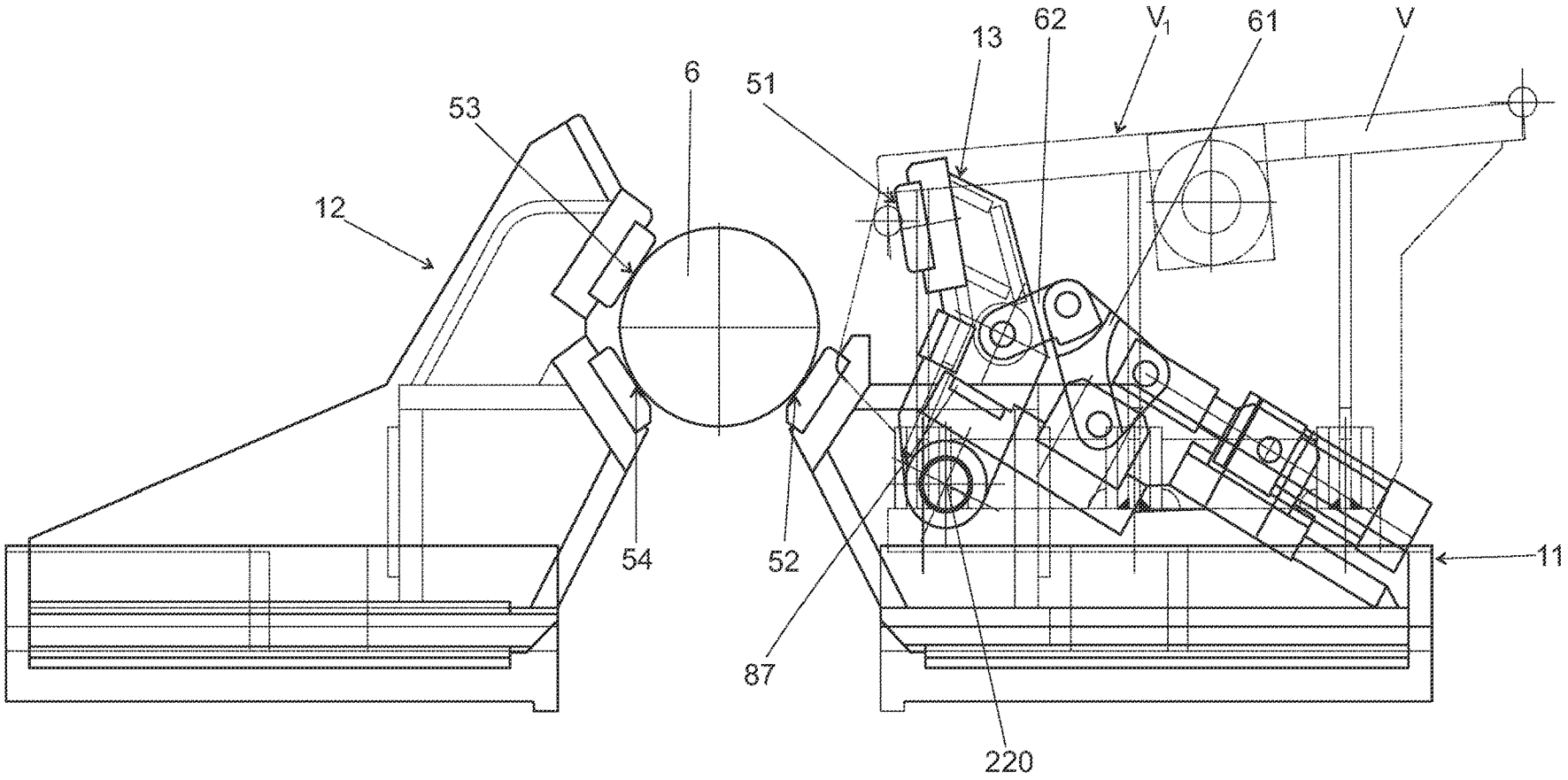

FIGS. 13 and 14 show, in sequence, the loading steps of mandrel 6 in the housing space SP defined by the abutment surfaces 51, 52, 53, 54. For this purpose, these Figures show, with a dashed line, a slide V comprising a tilted surface V1 along which mandrel 6 may slide or roll up to falling into the housing space SP. These Figures show only the slides 11, 12 for simplicity, while the support structure which carries them is omitted. The movable portion 13 is shown in the open position in both FIGS. 13 and 14.

Mandrel 6 is positioned on slide V (see FIG. 13) through suitable lifting means so that the same may fall into the housing space SP which remains delimited by the abutment surfaces 52, 53, 54 when the movable portion 13 is in open position (see FIG. 14).

In a possible embodiment, slide V may be replaced by one or more mechanical arms which position mandrel 6 in the housing space SP. The employment of mechanical arms simplifies the design of the plant and protects the abutment surfaces 52, 53, 54 against impacts. Mandrel 6 may be accompanied in the housing space SP, and therefore in contact with the abutment surfaces 52, 53, 54, through the employment of mechanical arms.

Figures 15, 15A:
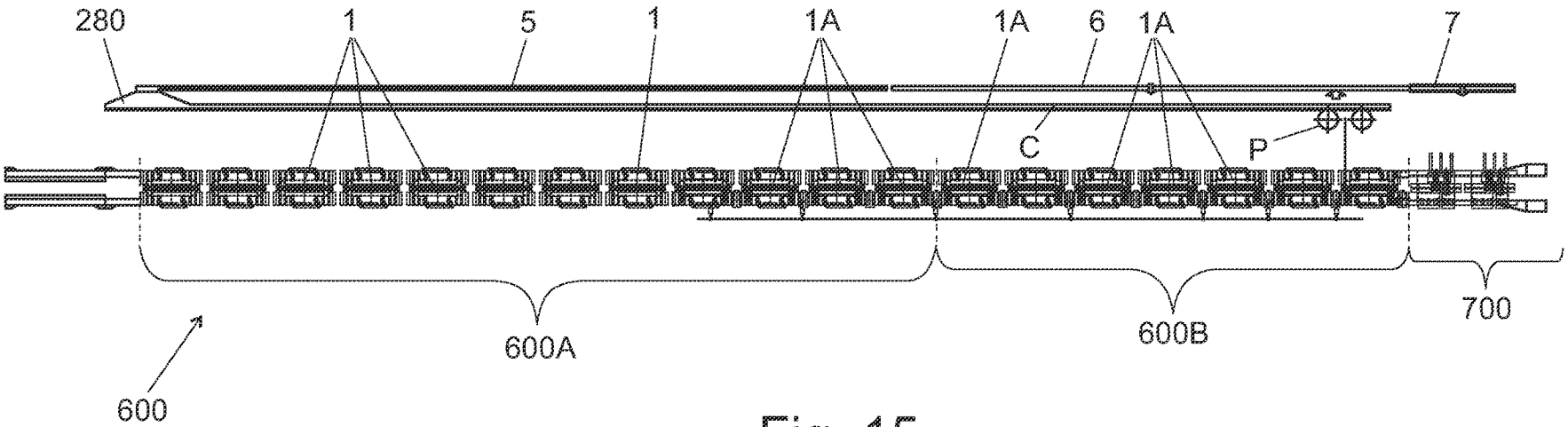
FIG. 15 is a view of a guide unit of a driving bar and of a mandrel comprising a plurality of guide devices according to the present invention.
FIG. 15A is a diagrammatic view of certain components of the guide unit in FIG. 15.

The present invention therefore also relates to a unit 600 for guiding a driving bar 5 and a mandrel 6 for a rolling plant of tubular bodies. With reference to FIGS. 15 and 15A, unit 600 according to the invention comprises a first section 600A for guiding a bar 5 and a second section 600B for guiding a mandrel 6 and the bar 5 itself. The second section 600B is downstream of the first section 600A with respect to the advancement direction 201 of the bar and mandrel. The rolling mill is positioned downstream of the second section 600B, in which rolling mill the hollow tube is processed after the insertion therein of mandrel 6 according to a principle in itself known. In particular, FIG. 15 indicates the inlet section 700 of the rolling mill in which the hollow tube 7 is positioned. Each of the sections 600A, 600B comprises a plurality of devices according to the present invention.

Figure 6:
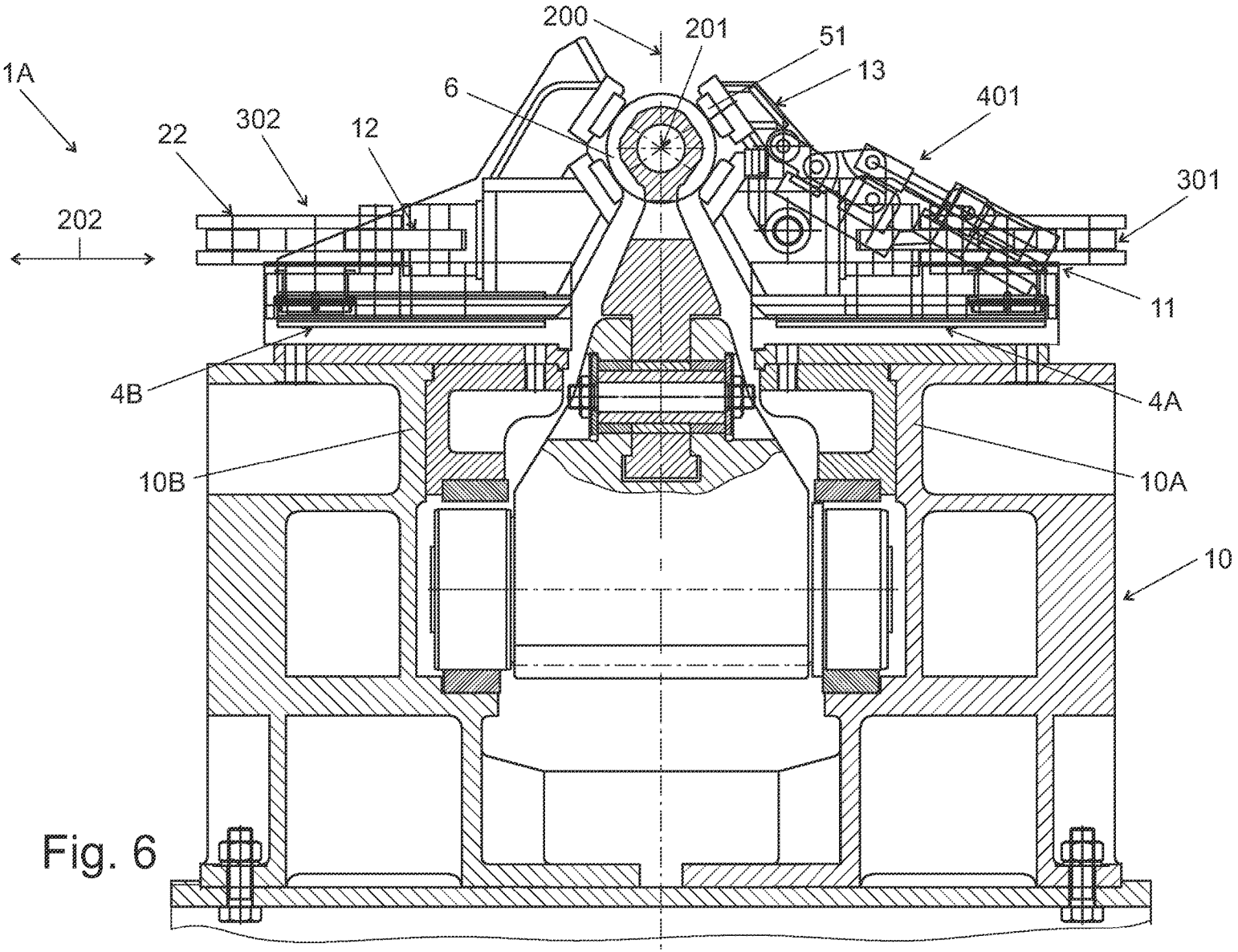

According to a preferred embodiment, the devices (indicated by numeral 1A in FIG. 15) of the second section 600B are of the type shown in FIG. 6, i.e. comprising rotation units 401, 402 for moving the movable portion 13 carrying one of the abutment surfaces 51, between a closed position and an open position. Thereby, mandrel 6 advantageously may be inserted in the housing space according to the above-described principles.

The second section 600B has a length (assessed along the advancement direction 201) which is greater than or equal to the length of mandrel 6. The employment is provided in the case shown, of mechanical arms which position mandrel 6 in the housing space SP defined by each guide device.

As indicated above, according to a known principle, the driving bar 5 is restrained to a head 280 moved along the advancement direction 201 through dragging means, preferably of the pinion-rack type (indicated by letters P and C in FIG. 15A). Bar 5 is entirely arranged in the first section 600A during the loading of mandrel 6 in the second section 600B. Once the loading of mandrel 6 is complete, the dragging means P, C are actuated, which cause the advancement of bar 5 along the movement direction 201. Bar 5 pushes the mandrel, which may be partly in the hollow body (check) or external thereto, and accordingly along the rolling mill, also in this case according to a process in itself known. Once mandrel 6 is completely in the hollow body, the dragging means bring bar 5 back into the first section 600A so as to prepare it for the successive thrust.

Figure 5:
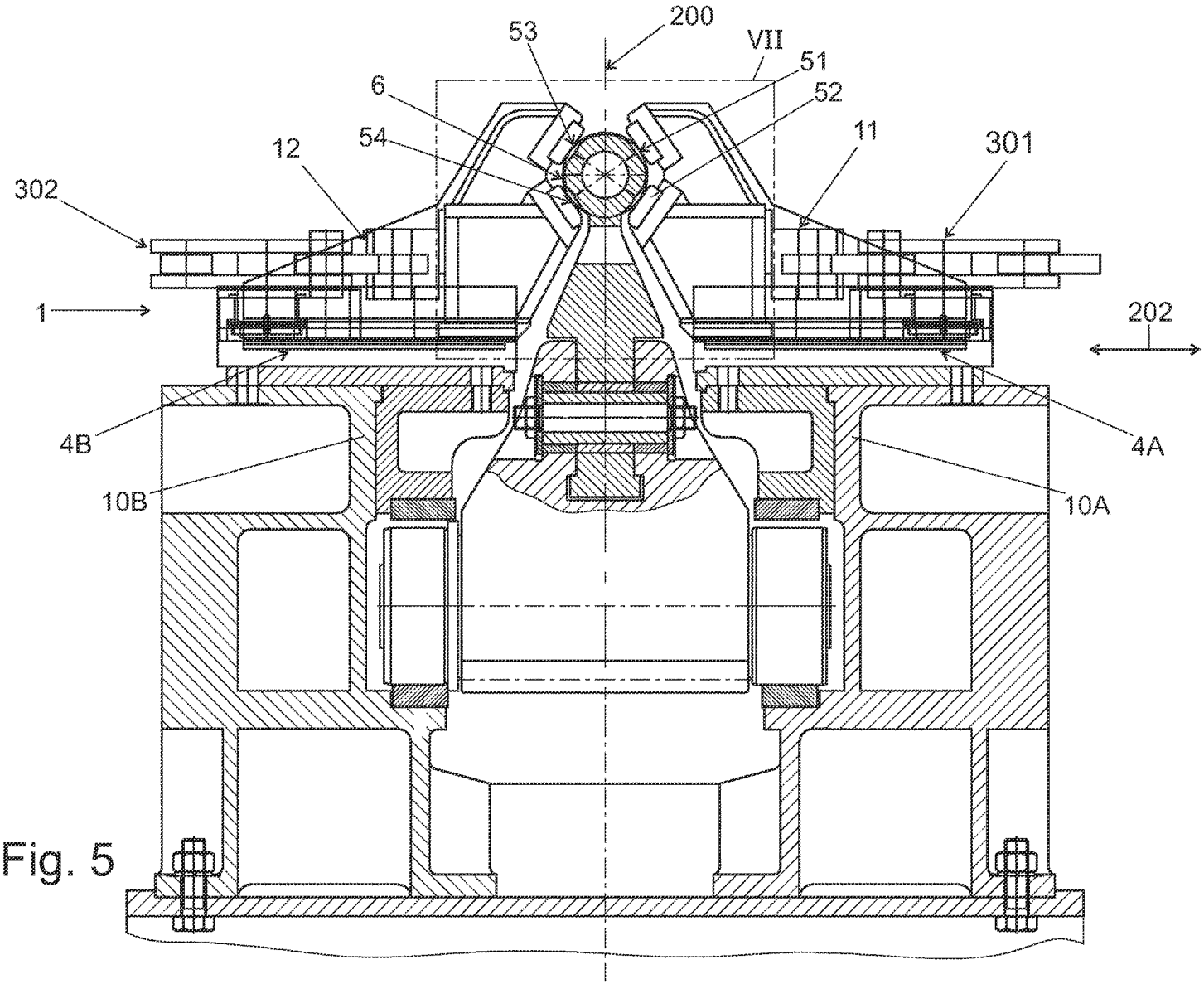
FIGS. 5 and 6 are front sectional views of a first embodiment and of a second embodiment of a guide device according to the present invention.

According to a preferred embodiment, the devices (indicated by numeral 1 in FIG. 15) of the first section 600A are of the type shown in FIG. 5, i.e. not comprising rotation units 401, 402 for moving a movable portion 13 carrying one of the abutment surfaces. In a different manner from the second section 600B, there is no need for the first section 600A to load a movable element at each operating cycle. However, according to a preferred embodiment, also certain devices (indicated by 1A) of the first section 600A immediately adjacent to the second section 600B could also be of the type shown in FIG. 6. Through this solution, the modules provided with a movable portion 13 could advantageously be exploited to perform the operation of replacing the driving bar 5 which, as is known, is to be performed at least each time the diameter is varied of mandrel 6 with which the rolling plant operates, in which the guide unit 600 according to the invention is provided. Practically, the replacement of the driving bar 5 is performed first by moving the movable portions 13 of the devices 1A into the open position and then replacing the bar used with the one to be employed.

The guide device according to the invention allows the tasks and preset objects to be wholly absolved. In particular, the configuration of the device according to the invention allows the wear of the abutment surfaces to be recuperated, and therefore the production of the plant to be increased through a significant reduction of the dead times. Simultaneously, the device according to the invention operatively adapts to a possible variation of the diameter of the mandrel, to the benefit of a reduction of the machine setting times. In general, the device according to the invention allows the frequency of the tooling operations to be simplified and highly contained, and therefore the management costs of the rolling plant associated with guiding the bar and/or mandrel to be reduced.

The invention claimed is:

1. A device for guiding a movable element in a rolling mill with mandrel, wherein said movable element is a driving bar of a mandrel or a mandrel, wherein said device comprises a support structure which defines an advancement direction for said movable element, wherein said device comprises a first slide and a second slide which are carried by said support structure and are slidable along a transverse direction which is orthogonal to said advancement direction, wherein each of said slides carries two abutment surfaces for guiding said movable element, each of said slides being movable along said transverse direction between at least a first operating position in which, when reached, said abutment surfaces come into contact with a movable element of a first predefined diameter, and at least a second operating position in which, when reached, said abutment surfaces come into contact with a movable element of a second predefined diameter, said device comprising actuating means which move said slides along said transverse direction between said operating positions and lock said slides when one of said operating positions is reached;

wherein said actuating means comprise a first moving unit for said first slide and a second moving unit for said second slide, wherein at least one of said moving units comprises:

an articulated mechanism configured to take on at least a first configuration corresponding to said first operating position and a second configuration corresponding to said second operating position;

thrust means for varying the configuration of said articulated mechanism;

and wherein said articulated mechanism comprises:

a first pair of levers and a second pair of levers and wherein for each pair of levers, a first lever is hinged to a first part of said support structure and a second lever is hinged to said first lever and to one of said corresponding slides;

a connecting rod which connects said first lever of said first pair of levers to said first lever of said second pair of levers, wherein said connecting rod synchronizes the rotation of said first levers, and wherein said thrust means are connected to said connecting rod or to one of said levers.

2. The device according to claim 1, wherein said at least two abutment surfaces of said first slide mirror said abutment surfaces of said second slide with respect to a vertical reference plane containing said advancement direction.

3. The device according to claim 1, wherein said abutment surfaces for at least one of said slides extend on corresponding planes of extension which are tilted with respect to a horizontal reference plane containing said advancement direction, wherein said planes of extension are tilted by a same angle ($\alpha$) with respect to said reference plane and intersect on said reference plane so that said abutment surfaces are reciprocally oriented according to a V shape.

4. The device according to claim 1, wherein said corresponding moving unit for at least one of said slides comprises a mechanical locking element which intervenes on the corresponding articulated mechanism, thus locking it in said first or second configuration and so that the configuration of said articulated mechanism can be varied only upon the actuation of said thrust means.

5. The device according to claim 1, wherein said thrust means are connected to said connecting rod and comprise a hydraulic, pneumatic or electric type actuator.

6. The device according to claim 4, wherein said mechanical locking element comprises an abutment surface against which said second lever of each pair of levers rests when said articulated mechanism takes on said second configuration.

7. The device according to claim 1, wherein at least one of said slides comprises a movable portion carrying a first abutment surface of said abutment surfaces, wherein said movable portion is movable between a closed position and an open position, when in said closed position, said first abutment surface comes in contact with said mandrel and wherein in said open position, said first surface occupies a position which is distal from said advancement direction and such as to allow the positioning of said mandrel in a housing space (SP) delimited by said other abutment surfaces.

8. The device according to claim 7, wherein said movable portion is rotatable between said closed position and said open position about a rotation axis parallel to said advancement direction, said device comprising at least one rotation unit for rotating said movable portion between said closed position and said open position.

9. The device according to claim 8, wherein said device comprises two rotation units installed on opposite end parts of said at least one of said slides, wherein said end parts are arranged along a direction parallel to said advancement direction.

10. The device according to claim 8, wherein said at least one rotation unit comprises:

an articulated kinematics configured to take on at least a first configuration corresponding to said closed position and a second configuration corresponding to said open position of said movable portion;

an operating element for varying the configuration of the kinematics from said first configuration to said second configuration or from said second configuration to said first configuration.

11. The device according to claim 10, wherein said at least one of said movement units comprises a mechanical locking element which acts on said articulated kinematics, thus locking it in said second configuration and so that the configuration of articulated kinematics can be varied only upon the actuation of said operating element.

12. The device according to claim 10, wherein said operating element comprises an actuator and wherein said articulated kinematics comprises:

a body hinged to said at least one slide and hinged to a rod of said actuator so that a translation of said rod corresponds to a rotation of the body;

a lever hinged to said movable portion of said slide and hinged to said body so that upon a rotation of said body with respect to said at least one slide, said lever causes a rotation of said movable portion and therefore a passing from said closed position to said open position or from said open position to said closed position.

13. The device according to claim 12, wherein said locking element comprises an abutment surface against which said lever rests when said articulated kinematics takes on said second configuration.

14. A unit for guiding a movable element in a mandrel rolling plant, wherein said movable element is a driving bar of a mandrel or a mandrel, and wherein said unit comprises a first section for guiding said bar and a second section for guiding said mandrel and said bar, wherein at least one of said first section and second section comprises at least one device according to claim 1.

* * * * *